US005493756A

United States Patent [19]

Shanok et al.

[11] Patent Number: 5,493,756

[45] Date of Patent: Feb. 27, 1996

[54] REFRIGERATOR DOOR HANDLE

[75] Inventors: Victor Shanok, New York, N.Y.; Joseph Limansky, East Brunswick, N.J.; William Shanok, New York; Valery Safronchik, Staten Island, both of N.Y.; Ronald Good, Bloomfield Hills, Mich.

[73] Assignee: Silvatrim Associates, South Plainfield, N.J.

[21] Appl. No.: 353,627

[22] Filed: Dec. 12, 1994

[51] Int. Cl.[6] ..... A47B 95/02

[52] U.S. Cl. ..... 16/111 R; 16/125

[58] Field of Search ..... 16/110 R, 111 R, 16/125, 114 R, DIG. 19, DIG. 5, 116 R, 124; 312/244, 405

[56] References Cited

U.S. PATENT DOCUMENTS

| | | | |
|---|---|---|---|
| 2,304,718 | 12/1942 | Swart | 16/125 |
| 3,995,349 | 12/1976 | Roberts et al. | 16/125 |
| 4,724,572 | 2/1988 | Gringer | 16/110 R |
| 4,745,656 | 5/1988 | Revlett | 16/125 |
| 4,799,306 | 1/1989 | Collins et al. | 16/111 R |
| 4,805,263 | 2/1989 | Kurtz | 16/124 |
| 5,259,089 | 11/1993 | Baur et al. | 16/125 |
| 5,402,553 | 4/1995 | Goetz et al. | 16/114 R |

FOREIGN PATENT DOCUMENTS

| | | | |
|---|---|---|---|
| 2430331 | 3/1980 | France | 16/DIG. 19 |

*Primary Examiner*—P. Austin Bradley
*Assistant Examiner*—Chuck Y. Mah
*Attorney, Agent, or Firm*—Goodman & Teitelbaum

[57] ABSTRACT

A refrigerator door handle including a pull handle and an integral one piece extruded plastic handle cover having handle extensions on opposite ends thereof, the handle extensions having legs thereon for securement to the refrigerator door. In another embodiment, the pull handle is provided with extension bases positioned at opposite ends thereof to receive the handle extensions of the handle cover in a snap-in engagement. In a further embodiment, the pull handle and handle extensions on opposite ends thereof are fabricated from an integral one piece extruded plastic profile. It is noted, that the pull handle extensions or bases can be provided with legs for securement to the refrigerator door.

37 Claims, 4 Drawing Sheets

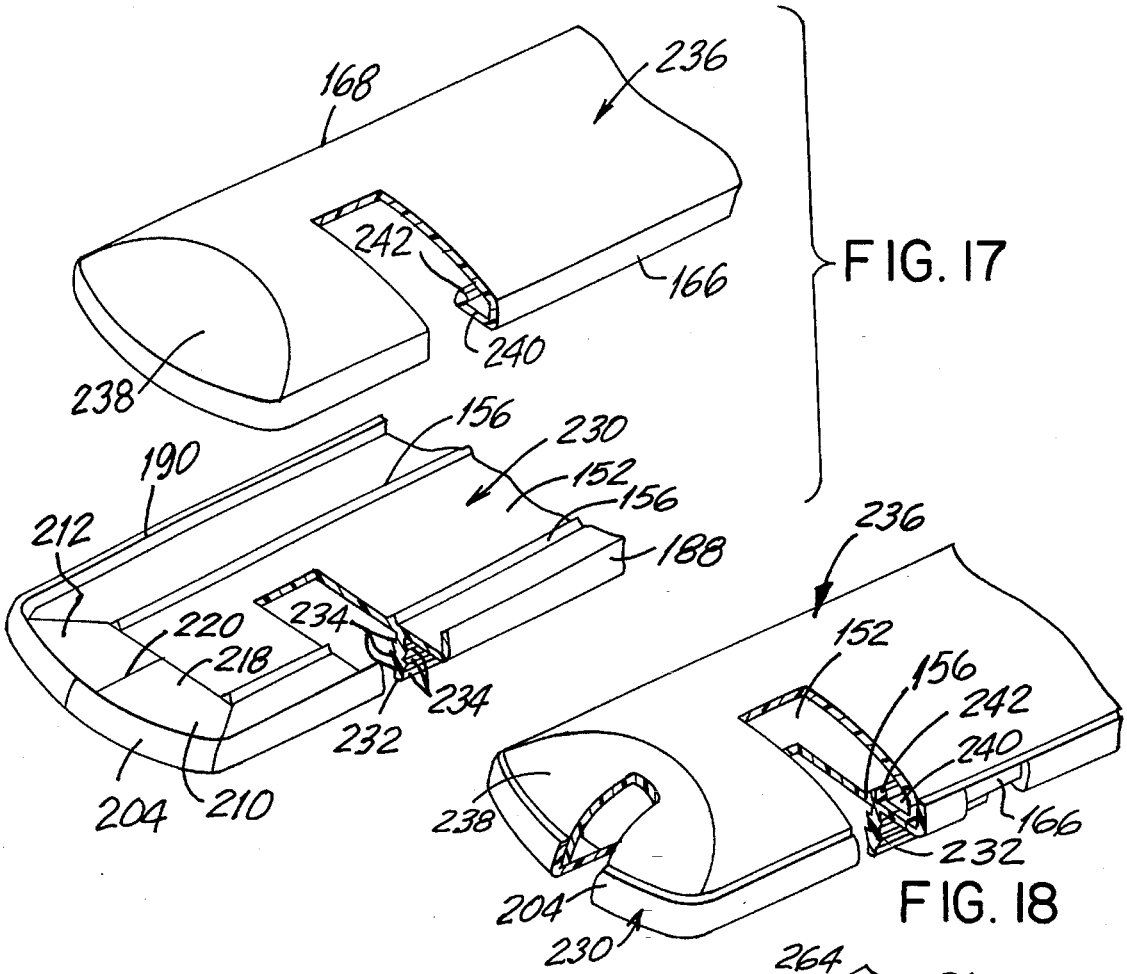
FIG. 17
FIG. 18
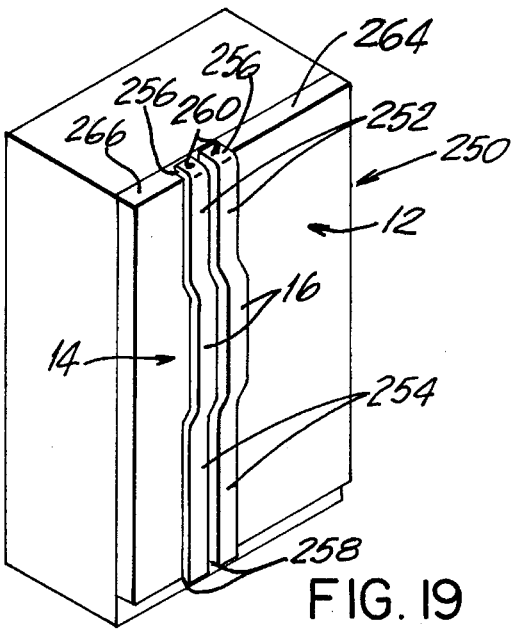
FIG. 19
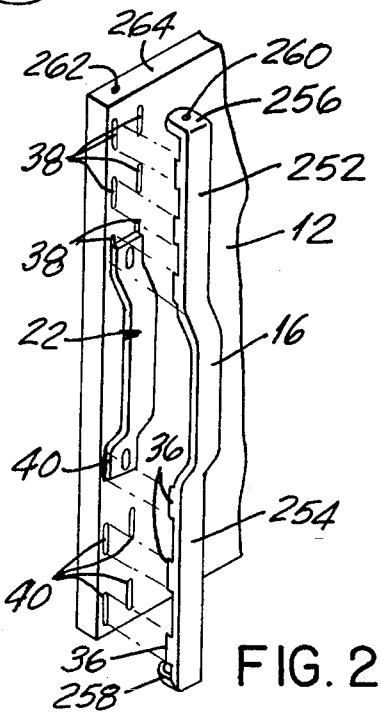
FIG. 20

REFRIGERATOR DOOR HANDLE

BACKGROUND OF THE INVENTION

The invention relates to a refrigerator door handle, and more particularly, to an extruded decorative plastic handle cover having handle extensions on opposite ends thereof for covering a pull handle secured to a refrigerator door, or alternately, to an extruded decorative plastic pull handle provided with handle extensions on opposite ends thereof for mounting on a refrigerator door.

Refrigerator door handles are well known in the prior art. At the present time, functional refrigerator door handles are produced by using cast or stamped metals which are mechanically fixed to the front of the refrigerator door. Because these handles have an unsightly appearance, they are frequently produced with an insert fabricated from a decorative material, such as a heavy vinyl or film, or an extruded or plastic material, or an injection molded material with decorative color and texturing to compliment or match the door front of the refrigerator. To achieve a flowing design, these functional handles are frequently mated to handle extension parts which are a combination of a number of different parts in a variety of constructions. Some utilize a metal or extruded roll-formed track which is screwed to the face of the refrigerator with lips designed into the track to secure a snap-on cover made of metal, or extruded or injection molded plastic. Other designs include a rear track with some decoration on the outer surface which is designed to accept an insert having a variety of complimentary finishes.

The prior art refrigerator door handles require extensive labor costs in the assembly thereof, a large number of mechnical attachment devices, and frequently produce a refrigerator door handle with unsightly seams at the joining points of the extensions and the handle, and unsightly injection molded end caps or metal stamped end caps at the outer most extensions of these parts. Accordingly, in general, most of the prior art refrigerator door handles do not provide a smooth, clean appearance on the refrigerator door.

U.S. Pat. No. 4,745,656 discloses a refrigerator door handle including a pull handle, hand extension bases and a plastic handle cover insert with extensions on opposite ends thereof, and with numerous mechanical parts and attachment devices for the securement thereof. Other refrigerator door handles are disclosed in U.S. Pat. Nos. 3,648,411, 4,087,141 and 4,926,523.

Accordingly, there is presently a need for a refrigerator door handle that utilizes a decorative one piece extruded plastic profile to provide either the handle cover and extensions on opposite ends thereof or the pull handle with the handle extensions on opposite ends thereof, which reduces the number of parts required for the assembly and securement thereof so as to reduce the labor costs in connection therewith, which eliminates the requirement of unsightly end caps at the outer most extensions thereof, and which eliminates the unsightly seams at the joining points thereof between the handle and the extension.

SUMMARY OF THE INVENTION

It is accordingly an object of the present invention to provide an extruded decorative plastic handle cover having handle extensions on opposite ends thereof for covering a pull handle secured to a refrigerator door which avoids the problems and disadvantages of the prior art devices.

Another object of the present invention is to provide an extruded decorative plastic pull handle provided with handle extensions on opposite ends thereof for mounting on a refrigerator door which avoids the problems and disadvantages of the prior art devices.

A further object of the present invention is to provide a refrigerator door handle including an integral one piece extruded plastic profile, where the profile is a handle cover or functions as a pull handle.

Still another object of the present invention is to provide a refrigerator door handle provided with an integral one piece cover handle having handle extensions on opposite ends thereof, where the handle extensions have legs thereon for engaging in the refrigerator door for securement thereof.

Another object of the present invention is to provide a refrigerator door handle, where the handle extensions snap into extension bases of the pull handle.

Yet another object of the present invention is to provide an integral one piece refrigerator door pull handle having handle extensions on opposite ends thereof.

Yet another object of the present invention is to provide a refrigerator door pull handle provided with handle extensions or bases having legs thereon which engage in the refrigerator door for securement thereto.

Still a further object of the present invention is to provide a refrigerator door handle which can be easily and inexpensively manufactured and assembled together, and can be simply and quickly installed on a refrigerator door.

Briefly, in accordance with the present invention, there is provided a refrigerator door handle including a pull handle and an integral one piece plastic extruded handle cover having handle extensions on opposite ends thereof, the handle extensions having legs thereon for securement to the refrigerator door. In another embodiment, the pull handle is provided with extension bases positioned at opposite ends thereof to receive the handle extensions of the handle cover in a snap-in engagement.

In a further embodiment, the pull handle and handle extensions on opposite ends thereof are fabricated from an integral one piece extruded plastic profile. It is noted, that the pull handle extensions or bases can be provided with legs for securement to the refrigerator door.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 17 is an exploded fragmented perspective view having cut-out portions, showing a modified handle extension and a base therefor;

FIG. 18 is a fragmented perspective view having cut-out portions, showing the assembly of the handle extension and base of FIG. 17;

FIG. 19 is a perspective view of a refrigerator having a further modified handle cover with handle extensions thereon for each refrigerator door;

FIG. 20 is an exploded fragmented perspective view showing the modified handle cover and extensions of FIG. 19 in position for mounting on the refrigerator door;

In the various figures of the drawings, like reference characters designate like parts.

DESCRIPTION OF THE PREFERRED EMBODIMENTS

Figure 1:
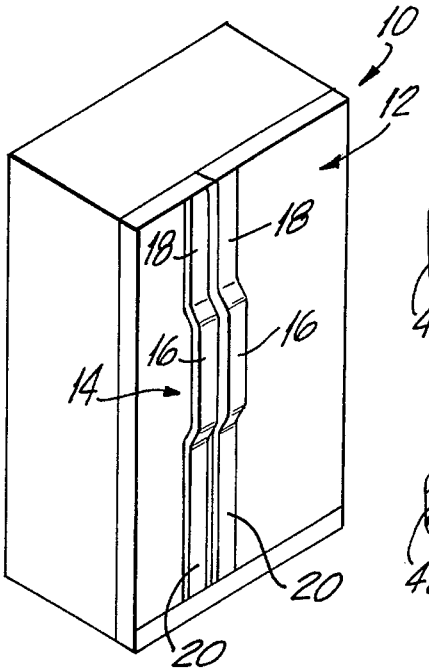
FIG. 1 is a perspective view of a refrigerator provided with an extruded decorative plastic handle cover having handle extensions on opposite ends thereof for each refrigerator door in accordance with the present invention.

Referring now to the drawings, FIG. 1 shows a side-by-side refrigerator 10 having two conventional doors, a refrigerator door 12 and a freezer door 14, each of the doors 12, 14 being provided with an identical extruded plastic handle cover 16 having upper and lower handle extensions 18, 20, respectively, on opposite ends thereof in accordance with the present invention. Accordingly, in that both handle covers 16 are identical, only the handle cover 16 on the refrigerator door 12 will be discussed in detail below.

Figure 2:
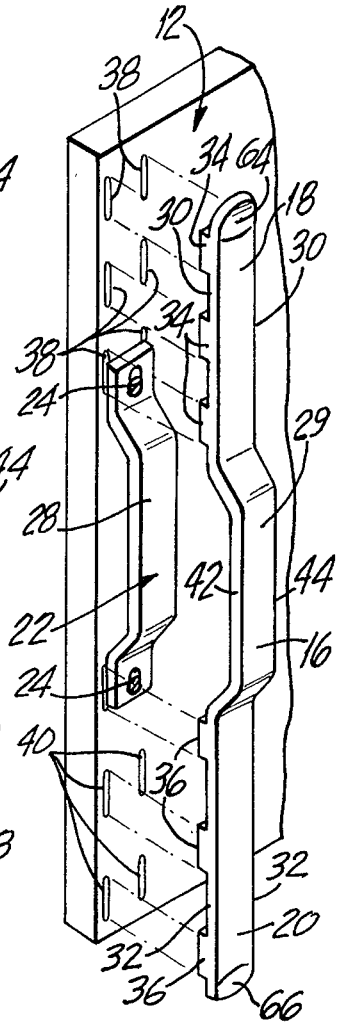
FIG. 2 is an exploded fragmented perspective view showing the handle cover with the handle extensions thereon, shown in FIG. 1, in position for mounting on the refrigerator door to cover the handle thereof.

FIG. 2 shows a conventional pull handle 22 secured at the top and bottom portions thereof by conventional means, such as screws 24, to a central portion of the outer surface of the refrigerator door 12, preferably adjacent to the outer longitudinal free edge 26 thereof. The pull handle 22 is fabricated from a rigid material, such as a cast or stamped metal or a suitable rigid plastic material, to provide a "solid feel". The pull handle 22 has a raised mid-section 28 spaced from the outer surface of the refrigerator door 12 so that an individual's fingers can be gripped through the space provided therebetween when opening the refrigerator door 12.

The handle cover 16 and handle extensions 18, 20 are formed from an integral one piece extruded plastic profile, which is cut to a predetermined longitudinal length and then bent to an appropriate radius and depth along its length to provide a raised section 29 to approximate the raised mid-section 28 of the pull handle 22 for covering same.

Preferably, the extruded plastic profile is decorated which can be done in a variety of ways, such as utilizing texturing directly on the plastic surface thereof or by the lamination of a textured film thereon. A high gloss appearance level can be created therefor through in-line extrusion treatments such as flaming or heat treating, or by the lamination thereon of bright finish films in metallic or colored combinations, or the use of hot stamping films, or discrete print on the surface of the plastic. Alternatively, the extruded plastic profile could be fabricated from a transparent plastic material having encapsulated therein a metallic strip so that the extruded plastic profile takes on the appearance of the metallic strip, such being well known in the art. For example, if the metallic strip has a silver metal-like finish, then a metal appearance would be provided. On the other hand, if the metallic strip has a wood grain finish, then a wood appearance would be provided.

The opposing longitudinally extending side edges 30, 32 of the handle extensions 18, 20, respectively, are provided with transversely aligned pairs of outwardly extending legs 34, 36, respectively. Accordingly, associated pairs of upper slots 38 are provided in the refrigerator door 12 to matingly receive the pairs of legs 34 therein. Likewise, associated pairs of lower slots 40 are provided in the refrigerator door 12 to matingly receive the pairs of legs 36 therein. The legs 34, 36 can be dimensioned for a force-fit in the slots 38, 40, respectively, to secure the handle extensions 18, 20 on the refrigerator door 12, or can be provided with tabs as set forth below.

Figure 3:
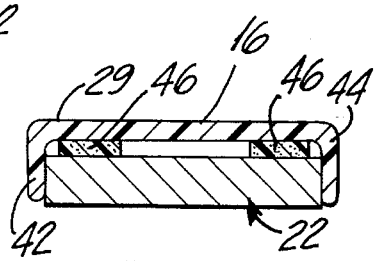
FIG. 3 is a cross sectional view showing means for securing the handle cover to the handle.
Figure 4:
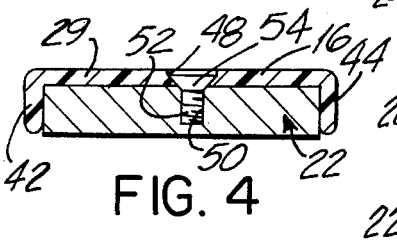
FIG. 4 is a cross sectional view similar to FIG. 3 showing another means for securing the handle cover to the handle.
Figure 5:
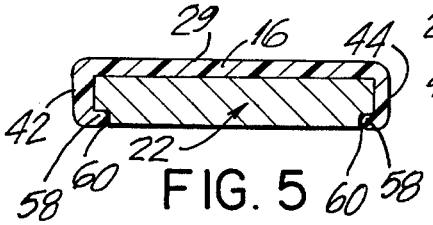
FIG. 5 is a cross sectional view similar to FIGS. 3 and 4 showing still another means for securing the handle cover to the handle.

Preferably, the longitudinally extending side edges 42, 44 of the handle cover 16 extend over the longitudinal side edges of the pull handle 22, as shown in FIGS. 3, 4 and 5. As shown in FIG. 3, longitudinal strips 46 of commercially available double sided adhesive foam tape are sandwiched between the inner surface of the handle cover 16 and the outer surface of the pull handle 22 to secure the handle cover 16 to the pull handle 22.

Alternately, longitudinally spaced apart openings 48 can be provided through the handle cover 16, and threaded holes 50 can be provided in the pull handle 22 in alignment with associated ones of the openings 48 to receive suitable screws 52. The threaded portion of each screw 52 passes through the opening 48 in the handle cover 16 and is threaded into the threaded hole 50 of the pull handle 22. Preferably, each hole 48 is tapered to capture the tapered head 54 of the screw 52 therein. As is well known in the art, a commercially available filler can be used to fill in the upper portion of the opening 48 above the screw head 54 or a decorative plug insert can be force-fit or mechanically snapped into the upper portion the opening 48 for decorative purposes so that the screw 52 is not visible.

In a further alternative construction as shown in FIG. 5, the ends of the side edges 42, 44 of the handle cover 16 can be directed inwardly to form longitudinally extending rails or flanges 56, 58, respectively, thereon. Additionally, longitudinally extending notches 60, 62 can be formed along the longitudinally extending bottom side edges of the pull handle 22. Thus, the side edges 42, 44 of the handle cover 16 are disposed on the side edges of the pull handle 22, and then the handle cover 16 is pushed towards the pull handle 22 until the flanges 56, 58 snap into the notches 60, 62, respectively to secure the handle cover 16 to the pull handle 22.

The opposite free end portions 64, 66 of the handle extensions 18, 20, respectively, as shown in FIG. 2, are closed by a finish treatment process which includes mechanically drawing the end portions 64, 66. Thereafter, the surplus material around the edges thereof is trimmed off to provide a finished end portion.

Figure 6:
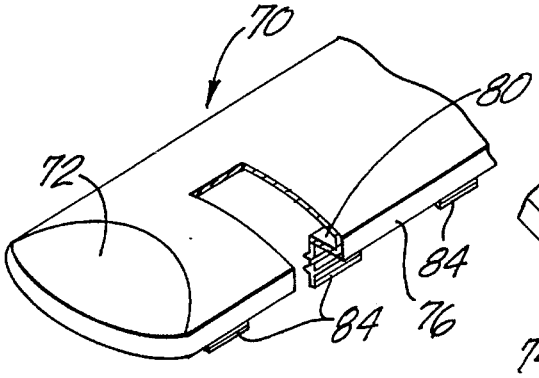
FIG. 6 is a fragmented perspective view having a portion cut-out, showing a modified handle extension.
Figure 7:
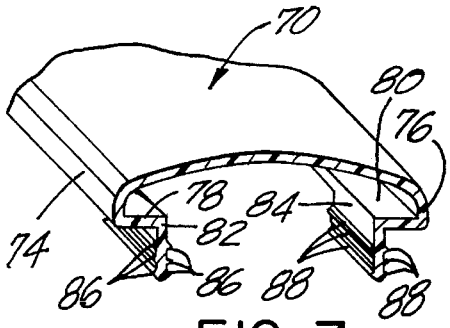
FIG. 7 is a fragmented cross sectional view of the handle extension of FIG. 6.

FIG. 6 shows a modified handle extension 70, which would be the same for both the upper and lower handle extensions, having a finished end portion 72 formed in the above mentioned mechanical manner. The longitudinally extending side edges 74, 76 of the handle extension 70 are turned inwardly to provide longitudinally extending flanges 78, 80, as best shown in FIG. 7. The inner ends of the flanges 78, 80 are turned downwardly in a vertical parallel arrangement with each other. Thereafter, the vertically downwardly turned portions are notched to form two rows of transversely aligned pairs of legs 82, 84 on the underside of the handle extension 70. Each of the legs 82, 84 has spaced apart longitudinally extending barbs or tabs 86, 88, respectively, on each side thereof in alignment with each other. As mentioned above, the legs 34, 36 of the handle extensions 18, 20, shown in FIG. 2, could be provided with the barbs or tabs 86, 88 in a like manner.

Here again, the associated pairs of upper and lower slots 38, 40 in the refrigerator door 12 matingly receive the pairs of legs 82, 84 of the handle extension 70. The legs 82, 84 are aligned with their associated slots 38, 40, and then the handle extension 70 is pushed towards the refrigerator door 12 so that the tabs 86, 88 snap into the refrigerator door slots 38, 40 and secure the handle extension 70 to the refrigerator door 12 with the flanges 78, 80 engaging against the outer surface of the refrigerator door 12. It is noted, in that the legs 82, 84 and their associated slots 38, 40 are disposed inwardly of the side edges 74, 76 of the handle extension 70, the handle extension 70 will conceal the refrigerator door slots 38, 40 when positioned on the refrigerator door 12.

Figure 8:
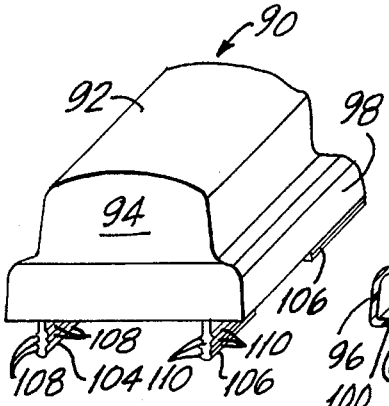
FIG. 8 is a fragmented perspective view showing a further modified handle extension.
Figure 9:
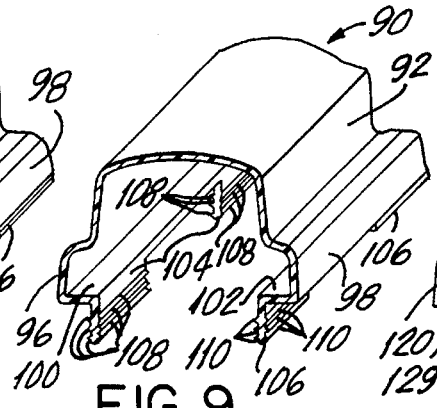
FIG. 9 is a fragmented cross sectional view of the handle extension of FIG. 8.

FIG. 8 shows a further modified handle extension 90, which is similar to the above mentioned handle extension 70 except the handle extension 90 has a raised body 92 which permits two, three or more adjacent surface areas to be disposed thereon to provide a desired decoration and differentiation by using the methods described above. Accordingly, in a manner indicated above, the handle extension 90 includes a finished end portion 94 formed in the above mentioned mechanical manner, longitudinally extending side edges 96, 98, inwardly turned longitudinally extending flanges 100, 102 as best shown in FIG. 9, two longitudinally extending rows of transversely aligned pairs of downwardly directed legs 104, 106, and spaced apart longitudinally extending barbs or tabs 108, 110 on each side of the legs 104, 106, respectively, in alignment with each other.

Figure 10:
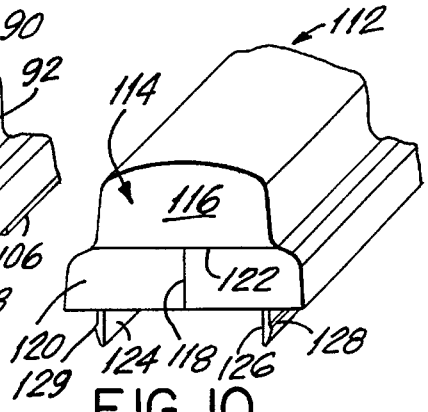
FIG. 10 is a fragmented perspective view of a still further modified handle extension.

FIG. 10 shows yet another modified handle extension 112 which is similar to handle extension 90 except for the modifications which will now be discussed. The handle extension 112 includes an end portion 114 having an upper part 116 and a lower part 120. The upper part 116 is finished in the above mentioned mechanical manner. However, the lower part 120 is first die cut and then folded together as shown in FIG. 10. Accordingly, the horizontal seam 122 and the vertical seam 118 formed in the folding operation are both fixedly secured in the joint area preferably by sonic welding, or any other suitable securement means, such as adhesive bonding, heat sealing, or mechanical means including decorative staples, rivets and the like, which are well known in the art. Furthermore, the two longitudinally extending rows of transversely aligned pairs of downwardly directed legs 124, 126 have only one longitudinal barb or tab 127, 128 on the outer side thereof, respectively, in alignment with each other.

Figure 11:
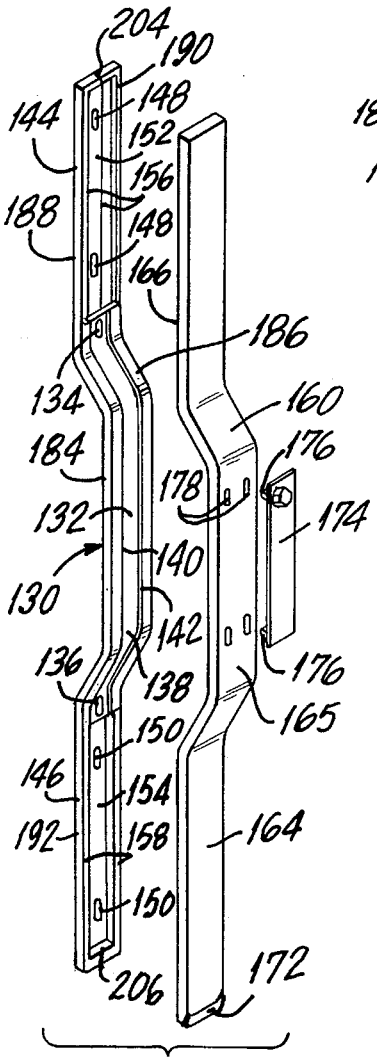
FIG. 11 is an exploded perspective view of a modified handle cover having handle extensions thereon for mounting on a handle provided with extension bases on opposite sides thereof.

FIG. 11 shows a modified pull handle 130 having a raised mid-section 132 with holes 134, 136 being provided in the opposite end portions of the pull handle 130 to receive screws therein, such as the above mentioned screws 24, for securing the pull handle 130 to the outer surface of the refrigerator door. A longitudinally extending recess 138 is provided in the pull handle 130, the function of which will be set forth below. Preferably, a pair of longitudinally extending reinforcement ribs 140, 142 are provided on the outer surface of the pull handle 130 within the recess 138, particularly when the pull handle 130 is fabricated from a plastic material.

A pair of upper and lower handle extension bases 144, 146 are provided at opposite longitudinal ends of the pull handle 130 in an abutting arrangement therewith, each having pairs of holes 148, 150, respectively, therein to receive screws, such as the above mentioned screws 24, to secure the handle extension bases 144, 146 to the outer surface of the refrigerator door in a longitudinal alignment with the pull handle 130. Here again, longitudinally extending recesses 152, 154 are provided in the handle extension bases 144, 146, respectively, the function of which will be indicated below. Each of the handle extension bases 144, 146 is also preferably provided with pairs of longitudinally extending reinforcement ribs 156, 158 within the recesses 152, 154, respectively. When mounted on the refrigerator door, associated ones of the reinforcement ribs 156, 158 of the handle extension bases 144, 146, respectively, are in alignment with the reinforcement ribs 140, 142 of the pull handle 130.

FIG. 11 also shows a modified cover handle 160 and handle extensions 162, 164 which are again formed from an integral one piece extruded plastic profile which is cut to a predetermined longitudinal length and then bent to an appropriate radius and depth along its length to provide a raised section 165 to approximate the raised mid-section 132 of the pull handle 130 for covering same. Preferably, here again the extruded plastic profile is decorated in the same manner as indicated above.

The opposing longitudinally extending side edges 166, 168 of the handle cover 160 and handle extensions 162, 164 are not provided with any legs thereon as in the above mentioned embodiment, where the method of attaching same will be set forth below. Additionally, the opposite end portions 170, 172 of the handle extensions 162 164, respectively, are mechanically drawn and finished in the same manner as the above mentioned end portions 64, 66.

Figure 12:
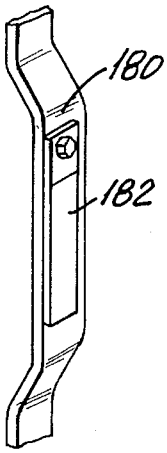
FIG. 12 is a fragmented perspective view showing a modified handle cover similar to the handle cover of FIG. 11.

It is common practice in the art to indicate on the handle the manufacturer's name and/or logo, and/or the model or style number to identify the appropriate refrigerator. In this case, a metal or plastic plate 174 having the above mentioned information and the like thereon is secured to the raised section 165 of the handle cover 160 by pairs of legs 176 extending downwardly from the side edges of the plate 174. The legs 176 are force-fitted into associated slots 178 formed through the raised section 165 of the handle cover 160 to fixedly secure the plate 174 on the handle cover 160. Alternately, as shown in FIG. 12, in a modified form of the handle cover 180, the above mentioned information and the like can be silk screened during the extrusion process onto the upper surface 182 of the raised portion of the handle cover 180.

Figure 13:
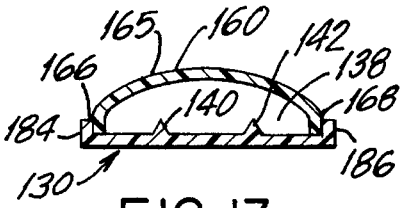
FIG. 13 is a cross sectional view showing the handle cover of either FIG. 11 or FIG. 12 mounted within the handle.

Accordingly, the pull handle 130, and the upper and lower handle extension bases 144, 146 are secured to the outer surface of the refrigerator door in alignment with each other by conventional screws, such as screws 24, which pass through the holes 134, 136 in the pull handle 130, the holes 148 in the upper handle extension bases 144, and the holes 150 in the lower handle extension base 146. Thereafter, the handle cover 160 is positioned in alignment on the pull handle 130 with the handle extension 162 being positioned in alignment on the upper handle extension base 144 and the handle extension 164 being positioned in alignment on the lower handle extension base 146. The longitudinal side edges 166, 168 of the handle cover 160 and the handle extensions 162, 164 are then snapped into the recesses 132, 152, 154 and abuttingly positioned between the longitudinal side edges 184, 186 of the pull handle 130, the longitudinal side edges 188, 190 of the upper handle extension base 144, and the longitudinal side edges 192, 194 of the lower handle extension base 146 for a tensioned biased securement therebetween, as indicated in FIG. 13.

Figure 14:
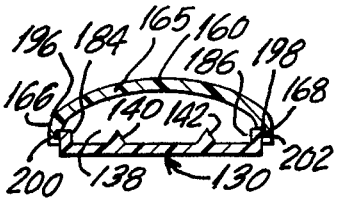
FIG. 14 is a cross sectional view showing the handle cover of either FIG. 11 or FIG. 12 mounted on the outside of the handle.

Alternately, as shown in FIG. 14, the longitudinal side edges 166, 168 of the handle cover 160 and the handle extensions 162, 164 can be snapped over the longitudinal side edges 184, 186 of the pull handle 130, the longitudinal side edges 188, 190 of the upper handle extension based 144 and the longitudinal side edges 192, 194 of the lower handle extension base 146. However, in this later snap-over arrangement, the inner walls of the longitudinal side edges 166, 168 of the handle cover 160 and the handle extensions 162, 164 are preferably provided with longitudinally extending recesses 196, 198 to receive longitudinally outwardly extending flanges 200, 202 perpendicularly provided on the longitudinal side edges 184, 186 of the pull handle 130, the longitudinally extending side edges 188, 190 of the upper handle extension base 144 and the longitudinally extending side edges 192, 194 of the lower handle extension base 146 to provide a secure tonguein-groove engagement therebetween.

It is understood, that the end portions 170, 172 of the handle extensions 162, 164, respectively, would also be either snapped into the end portions 204, 206 of the upper and lower handle extension bases 144, 146, respectively, in the manner mentioned above with respect to FIG. 13, or can be snapped-over the end portions 204, 206 of the upper and lower handle extension bases 144, 146, respectively, also in the manner mentioned above with respect to FIG. 14, either with or without the tongue and groove arrangement.

Figure 15:
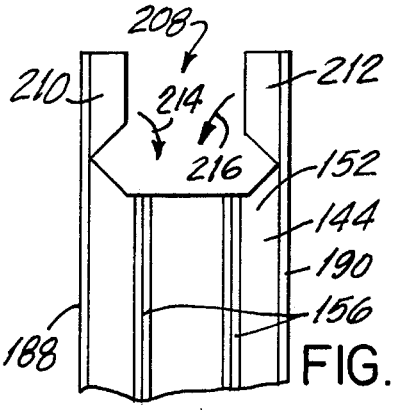
FIG. 15 is a fragmented top plan view showing the end portion of the handle extension base having a cut-away portion to finish same.
Figure 16:
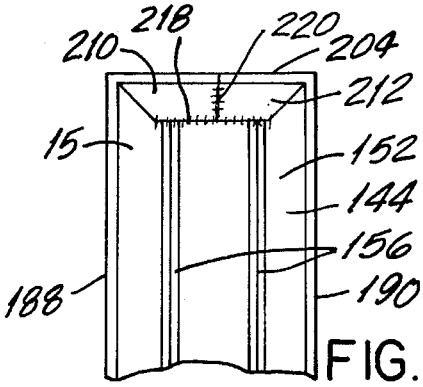
FIG. 16 is a fragmented top plan view similar to FIG. 15, showing the finished end portion of the handle extension base.

As shown in FIG. 15, the end of the upper handle extension base 144, as well as the end of the lower handle extension base 146, is die cut to form a particular cut-out 208 forming arms 210, 212 on opposite sides thereof. Thereafter, the arms 210, 212 are bent inwardly towards each other in the direction of the arrows 214, 216 so that the free ends of the arms 210, 212 abut against each other and fill the cut-out 208 as shown in FIG. 16. The horizontal seam 218 and the vertical seam 220 formed in the bending of the arms 210, 212 are both fixedly secured in the joint area by sonic welding, which is well known in the art, to form the end portion 204. Obviously, the same procedure is followed for the lower handle extension 146.

FIG. 17 shows a modified plastic handle extension base 230, which can be used for either the upper or the lower handle extension base, so that only reference will be made to the upper extension base 144 which is structurally the same as the lower extension base 146, as shown in FIG. 11. The extension base 230 is similar to the above mentioned upper extension base 144, and includes the longitudinally extending recess 152, the pairs of longitudinally extending reinforcement ribs 156, the longitudinally extending side edges 188, 190, and the end portion 204 formed by the arms 210, 212 and joined at the horizontal seam 218 and vertical seam 220.

However, in place of the holes 148 in the upper handle extension base 144, the handle extension base 230 is provided with two longitudinal rows of transversely aligned pairs of legs 232 extending perpendicularly downwardly from the underside of the handle extension base 230. The legs 232 are similar to the above mentioned legs 82, 84 shown in FIGS. 6 and 7, having spaced apart longitudinally extending barbs or tabs 234 on opposite sides thereof in alignment with each other. Accordingly, the legs 232 function in the same manner as the above mentioned legs 82, 84, being matingly received in the associated pairs of upper and lower slots 38, 40 in the refrigerator door 12, shown in FIG. 2, in the same manner mentioned above so that a further explanation thereof is not thought necessary. It is noted, that the handle extension base 230 could be provided with only one centrally disposed, longitudinally extending row of legs 232 which are received in associated slots in the refrigerator door 12, in a like manner as disclosed below in FIGS. 25 and 26.

FIG. 17 also shows a modified plastic handle extension 236, which for the most part is similar to either one of the above mentioned handle extensions 162, 164, so that the description below will apply to each of the handle extensions. The handle extension 236 includes the opposing longitudinally extending side edges 166, 168, which as indicated above, extend along the upper handle extension, along the handle cover and along the lower handle extension. Furthermore, the end portion 238 is formed in the same manner as end portions 64, 66, 72 shown in FIGS. 2 and 6, so that a further explanation is not thought necessary.

Accordingly, handle extension 236 differs from the above mentioned handle extensions in that the longitudinally extending side edges 166, 168 are each provided with an inwardly directed, perpendicular flange 240 extending longitudinally along the upper handle extension, along the handle cover and along the lower handle extension, each flange 240 having an upwardly directed perpendicular rib 242 on the free end thereof running the entire longitudinal length of each flange 240. Each flange 240 has a predetermined width equal to approximately the transverse spacing between the longitudinally extending side edge 188 or 190 and its adjacent associated rib 156, the function of which will be explained below.

In the manner described above, the pull handle 130, shown in FIG. 11, is first secured to the refrigerator door 12, in the position indicated in FIG. 2, and then an upper and a lower handle extension base 230 of FIG. 17 is also secured to the refrigerator door 12 in the manner discussed above by inserting the legs 232 into the slots 38 and 40. Thereafter, also in the manner discussed above with respect to FIG. 13, the integral one piece profile, which includes an upper and lower handle extension 236 with the handle cover disposed therebetween, is aligned with the upper and lower handle extension base 236 and pull handle 130 so that the longitudinal side edges 166, 168 of the handle cover and handle extensions 236 are snapped into position between the longitudinal side edges 184, 186 of the pull handle 130 and the longitudinal side edges 188, 190 of the upper and lower handle extension bases 230 for securement therebetween.

Accordingly, during the above mentioned securement, one flange 240 is snapped between the longitudinally extending side wall 188 and the adjacent associated rib 156 on one side, with the other flange 240 being snapped between the longitudinally extending side wall 190 and its associated rib 156 on the other side thereon. Additionally, each rib 242 of the handle extension 236, on both sides thereof, abuts against an associated one of the reinforcement ribs 156 so that the reinforcement ribs 156 also function as an abutment for securement of associated ones of the flanges 240 and ribs 242, as shown in FIG. 18. Likewise, it is noted that the flanges 240 on the handle cover will be secured between the longitudinally extending side wall 184 and its associated reinforcement rib 140 on one side, and the longitudinally extending side wall 186 and its associated reinforcement rib on the other side of the pull handle 130, with the ribs 242 of the cover handle abutting against associated ones of the reinforcement ribs 140, 142 in the above mentioned manner.

FIG. 19 shows a side-by-side refrigerator 250 similar to the refrigerator 10 shown in FIG. 1. However, the handle cover 16 is provided with modified upper and lower handle extensions 252, 254. The upper handle extension 252 includes a wrap-over portion 256 perpendicular thereto, and the lower handle extension 254 includes a wrap-under portion 258, as best shown in FIG. 20. Accordingly, the longitudinally extending side edges of the upper and lower handle extensions 252, 254 are suitably enlarged so that the end portions thereof can be bent perpendicularly thereto to form the wrap-over portion 256 and the wrap-under portion 258. Accordingly, holes 260 are formed through each of the wrap-over and wrap-under portions 256, 258. Additionally, associated threaded holes 262 to receive conventional screws, or unthreaded holes to receive self-tapping screws, are formed in the upper and lower edges 264, 266 of the doors 12, 14, respectively.

In the same manner as mentioned above, the handle cover 16 and handle extensions 252, 254 are secured to the refrigerator doors 12, 14 so that the legs 34 engage in the refrigerator door slots 38, and the legs 36 engage in the refrigerator door slots 40 to thus position the wrap-over portion 256 on the door edge 264 and the wrap-under portion 258 on the bottom door edge with the holes 260 being in alignment with the associated threaded holes 262. Conventional screws, or self-tapping screws, are now used to pass through the holes 260 for threaded engagement in the associated threaded holes 262 or the unthreaded holes, respectively. It is noted, as mentioned above, that the heads of the screws or self-tapping screws should be countersunk, and the space above the screw heads is preferably filled with an appropriate filler, or plugged with a decorative insert that either is force-fit or mechanically snapped into the upper portion of the holes 260.

Figure 21:
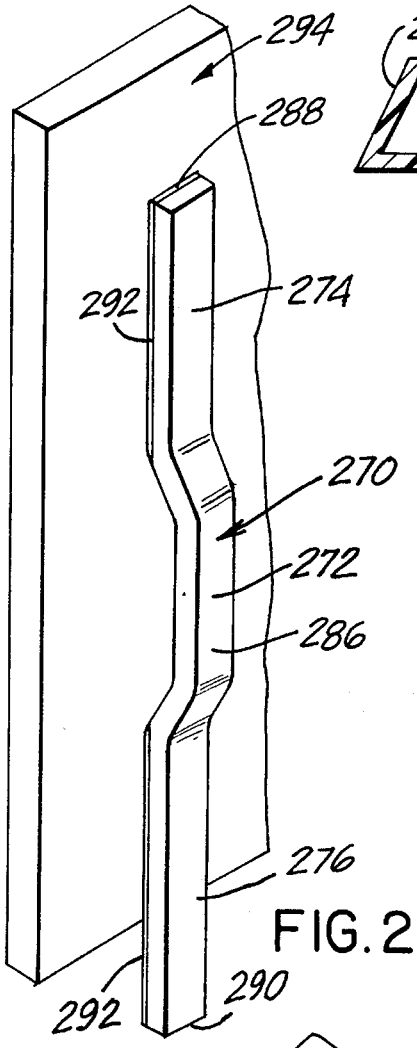
FIG. 21 is an exploded fragmented perspective view showing a pull handle provided with handle extensions thereon in position for mounting on the refrigerator door, in accordance with the present invention.
Figure 22:
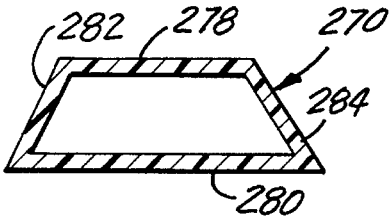
FIG. 22 is a cross sectional view of the integral one piece profile forming the handle and handle extensions of FIG. 21.

It is noted, that all the above embodiments included a pull handle and a handle cover therefor forming a two part construction. Accordingly, FIG. 21 shows an integral one piece extruded plastic construction or profile 270 including a pull handle 272 having upper and lower handle extensions 274, 276 extending outwardly therefrom. As shown by the cross-sectional view in FIG. 22, the profile 270 is a hollow tube having a top wall 278, a base wall 280 and side walls 282, 284. Preferably the side walls 282, 284 are inclined away from each other from the top wall 278 to the base wall 280 to provide a trapezoidal cross-section.

In the above manner, the mid-section 286 of the profile 270 is bent to a predetermined radius and depth along its length so that the mid-section 286 is suitably raised to form the pull handle 272. The opposite end portions 288, 290 of the handle extensions 274, 276, respectively, are formed in the above mentioned manner, either by mechanically drawing same as indicated in FIG. 8, or by die cutting same as indicated in FIG. 10. However, it is understood, that conventional separate decorative end caps can also be provided on the free ends of the handle extensions 274, 276 for closing the hollow tube construction of the profile 270.

Furthermore, the top and side walls 278, 282, 284 can be decoratively finished in the same manner indicated above. Additionally, an information plate, such as above plate 174 shown in FIG. 11, can be provided on the pull handle 272 or the pull handle 272 can be silk screened with the information as indicated in FIG. 12.

A suitable adhesive 292 is applied on the under surface of the base wall 280 of the upper and lower handle extensions 274, 276. Thereafter, the profile 270 is properly positioned and pressed against the outer surface of the refrigerator door 294 so that the adhesive 292 secures the upper and lower handle extensions 274, 276 to the refrigerator door 294. However, it is understood that other suitable means can be used to secure the handle extensions 274, 276 to the refrigerator door 294, such as conventional suitable two sided adhesive tape, or other means such as described below.

Figure 23:
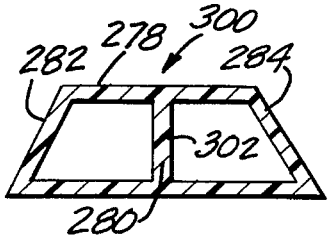
FIG. 23 is a cross sectional view similar to FIG. 22, showing the integral one piece profile provided with a reinforcing portion.

The profile 270 is fabricated from a suitable rigid plastic material such as acrylonitrile butadine styrene (ABS), nylon, polyester, rigid vinyl and the like, so that the profile 270 has a suitable firm and rigid construction required for a pull handle. However, in some cases, the profile 270 would require additional strength in the function thereof. Accordingly, FIG. 23 shows a modified profile 300 constructed in exactly the same way as profile 270, except profile 300 includes a reinforcing strut 302 disposed vertically between and perpendicular to the top wall 278 and the base wall 280 to provide the additional required strength thereto. The reinforcing strut 302 extends longitudinally through the entire profile 300, being disposed in the pull handle 270 and the handle extensions 274, 276.

Figure 24:
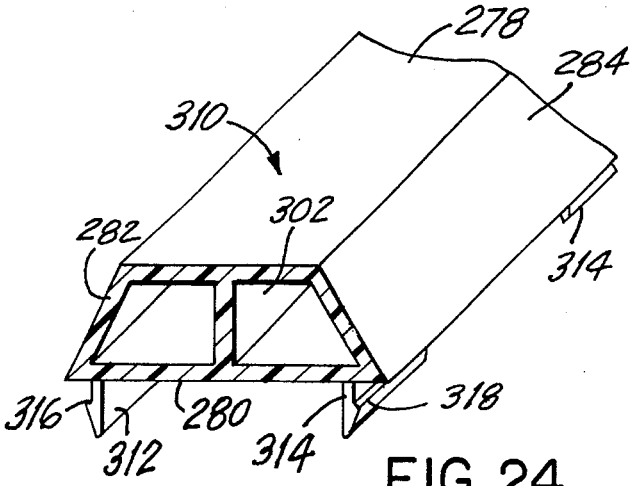
FIG. 24 is a fragmented perspective view having a cross section similar to FIG. 23, showing a handle extension provided with two rows of spaced apart aligned legs to secure same to the refrigerator door.

FIG. 24 discloses a modified profile 310 having a construction similar to the above mentioned profile 300, except profile 320 has two longitudinally extending rows of aligned pairs of legs 312, 314 depending downwardly from the underside of the base wall 280, similar to the above legs shown in FIGS. 6, 7, 8, 9, 10, 17 and 18. Each of the legs 312, 314 has a longitudinally extending barb or tab 316, 318, respectively, on the outer surface thereof, similar to the legs shown in FIG. 10, for securing the profile 310 to the refrigerator door in the manner numerously mentioned above. Obviously, the legs 312, 314 are only provided on the upper and lower handle extensions 274, 276. It is noted, that the profile 310 can be modified so as not to include the reinforcing strut 302 therein.

Figure 25:
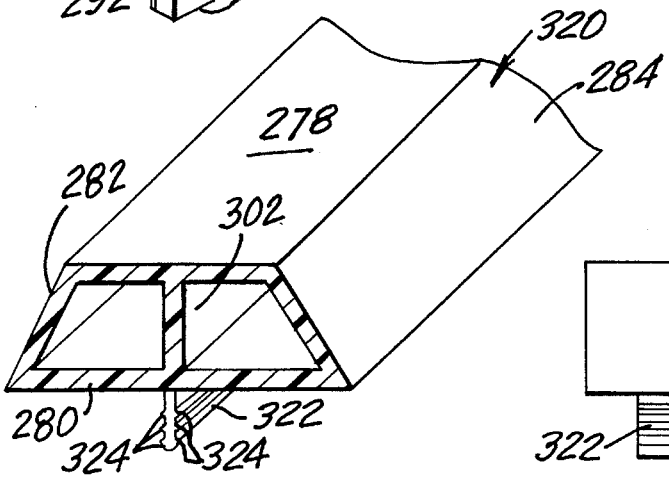
FIG. 25 is a fragmented cross sectional perspective view similar to FIG. 24, showing a handle extension provided with one centrally extending row of legs for securing same to the refrigerator door.
Figure 26:
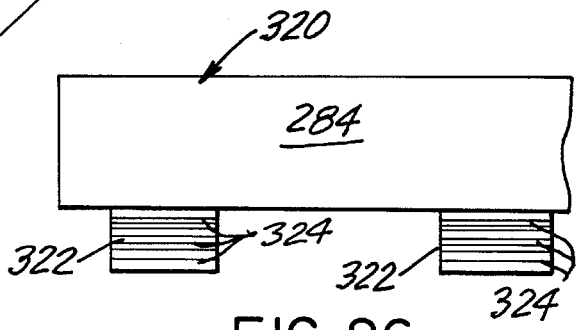
FIG. 26 is a fragmented side elevational view of the handle extension of FIG. 25.

FIGS. 25 and 26 also disclose a modified profile 320 having a construction similar to the above mentioned profile 300, except unlike the profile 310, the profile 320 only has one longitudinally extending row of legs 322 depending downwardly from the underside of the base wall 280, the legs 322 preferably being centrally disposed along the base wall 280. Each of the legs 322 has spaced apart longitudinally extending barbs or tabs 324 on each side of the legs 322 in alignment with each other, similar to the barbs or tabs on the legs mentioned above. Accordingly, the legs 322 are only provided on the upper and lower handle extensions 274, 276, and are received in associated slots provided in the refrigerator door for securing the profile 320 to the refrigerator door. Here again, the profile 320 can be modified so as not to include the reinforcing strut 302 therein.

Numerous alterations of the structures herein disclosed will suggest themselves to those skilled in the art. However, it is to be understood that the present disclosure relates to preferred embodiments of the invention which are for the purpose of illustration only, and are not to be construed as limitations of the invention.

What is claimed is:

1. A refrigerator door handle comprising:

a pull handle for securing to a refrigerator door, said pull handle having longitudinally extending side edges, and also having a raised mid-section to permit a user's fingers to grip thereunder;

an integral one piece extruded plastic profile consisting of a handle cover provided with handle extensions on opposite ends of said handle cover;

said handle extensions extending longitudinally outwardly in opposite directions from said handle cover, each of said handle extensions having opposing longitudinally extending side edges;

said handle extensions being disposed in a first plane, said handle cover having longitudinally extending side edges, and said handle cover also having a bent raised section disposed in a second plane spaced from said first plane to matingly match said mid-section of said pull handle for covering said pull handle;

first means for securing said handle cover to said pull handle;

second means for securing said handle extensions to the refrigerator door; and said second means including longitudinally spaced apart legs extending outwardly from both of said handle extensions to be securely received in associated slots provided in the refrigerator door.

2. A refrigerator door handle according to claim 1, wherein transversely aligned pairs of said legs are provided on said opposing longitudinally extending side edges of each of said handle extensions.

3. A refrigerator door handle according to claim 1, wherein longitudinally extending tab means are provided on each of said legs to secure said legs in the slots provided in the refrigerator door.

4. A refrigerator door handle according to claim 3, wherein said tab means are provided only on one outer side of each of said legs.

5. A refrigerator door handle according to claim 3, wherein said tab means are provided on both opposing sides of each of said legs.

6. A refrigerator door handle according to claim 3, wherein said opposing longitudinally extending side edges of each of said handle extensions are turned inwardly to provide longitudinally extending flanges for engagement against the refrigerator door, said legs extending outwardly from said flanges so that said handle extensions conceal the slots provided in the refrigerator door when positioned thereon.

7. A refrigerator door handle according to claim 1, wherein said opposing longitudinally extending side edges of each of said handle extensions are turned inwardly to provide longitudinally extending flanges for engagement against the refrigerator door, said legs extending outwardly from said flanges so that said handle extensions conceal the slots provided in the refrigerator door when positioned thereon.

8. A refrigerator door handle according to claim 1, wherein said longitudinally extending side edges of said handle cover extend over said longitudinal side edges of said pull handle, and said first means includes double sided adhesive foam tape sandwiched between an inner surface of said handle cover and an outer surface of said pull handle.

9. A refrigerator door handle according to claim 1, wherein said longitudinally extending side edges of said handle cover extend over said longitudinal side edges of said pull handle, and said first means includes screws passing through holes in said handle cover and threaded in said pull handle.

10. A refrigerator door handle according to claim 1, wherein said first means includes said longitudinally extending side edges of said handle cover being disposed in a recess provided in said pull handle in an abutting position against inner walls of said longitudinally extending side edges of said pull handle for a tensioned biased securement therebetween.

11. A refrigerator door handle according to claim 1, wherein opposite free ends of said handle extensions are each perpendicularly bent to provide a wrap-over portion disposed over a top edge of the refrigerator door, and a wrap-under portion disposed under a bottom edge of the refrigerator door.

12. A refrigerator door handle comprising:

a pull handle for securing to a refrigerator door, said pull handle having longitudinally extending side edges, and also having a raised mid-section to permit a user's fingers to grip thereunder;

an integral one piece extruded plastic profile consisting of a handle cover provided with handle extensions on opposite ends of said handle cover;

said handle extensions extending longitudinally outwardly in opposite directions from said handle cover;

said handle extensions being disposed in a first plane, said handle cover having longitudinally extending side edges, and said handle cover also having a bent raised section disposed in a second plane spaced from said first plane to matingly match said mid-section of said pull handle for covering said pull handle;

first means for securing said handle cover to said pull handle;

second means for securing said handle extensions to the refrigerator door;

said longitudinally extending side edges of said handle cover extending over said longitudinal side edges of said pull handle; and said first means including ends of said side edges of said handle cover being directed inwardly to provide longitudinally extending flanges for being securely received in associated longitudinally extending notches provided along a bottom portion of said side edges of said pull handle.

13. A refrigerator door handle according to claim 12, wherein opposite free ends of said handle extensions are each closed with an end portion extending between longitudinal side edges thereof.

14. A refrigerator door handle according to claim 13, wherein said end portion has a mechanically drawn construction.

15. A refrigerator door handle according to claim 13, wherein portions of said end portion are bent and secured together in a predetermined arrangement.

16. A refrigerator door handle according to claim 12, wherein said handle cover is provided with an information plate on an outer surface thereof.

17. A refrigerator door handle according to claim 12, wherein information is provided on an outer surface of said handle cover.

18. A refrigerator door handle according to claim 12, wherein said second means includes handle extension bases provided at opposite ends of said pull handle in longitudinal alignment therewith, each of said handle extension bases matingly receiving an associate one of said handle extensions, and securement means for securing said handle extension bases to the refrigerator door.

19. A refrigerator door handle according to claim 18, wherein said securement means includes screws passing through holes in said handle extension bases and threaded in the refrigerator door.

20. A refrigerator door handle according to claim 18, wherein longitudinally extending reinforcement ribs extend outwardly from an outer surface of said pull handle and said handle extension bases.

21. A refrigerator door handle according to claim 12, wherein opposite free ends of said handle extensions are each perpendicularly bent to provide a wrap-over portion disposed over a top edge of the refrigerator door, and a wrap-under portion disposed under a bottom edge of the refrigerator door.

22. A refrigerator door handle comprising:

a pull handle for securing to a refrigerator door, said pull handle having longitudinally extending side edges, and also having a raised mid-section to permit a user's fingers to grip thereunder;

an integral one piece extruded plastic profile consisting of a handle cover provided with handle extensions on opposite ends of said handle cover;

said handle extensions extending longitudinally outwardly in opposite directions from said handle cover;

said handle extensions being disposed in a first plane, said handle cover having longitudinally extending side edges, and said handle cover also having a bent raised section disposed in a second plane spaced from said first plane to matingly match said mid-section of said pull handle for covering said pull handle;

first means for securing said handle cover to said pull handle;

second means for securing said handle extensions to the refrigerator door;

said longitudinally extending side edges of said handle cover extending over said longitudinal side edges of said pull handle; and said first means including ends of said side edges of said pull handle being directed outwardly to provide longitudinally extending flanges for being securely received in associated longitudinally extending recesses provided in inner walls of said side edges of said handle cover.

23. A refrigerator door handle comprising:

a pull handle for securing to a refrigerator door, said pull handle having a raised mid-section to permit a user's fingers to grip thereunder;

an integral one piece extruded plastic profile consisting of a handle cover provided with handle extensions on opposite ends of said handle cover;

said handle extensions extending longitudinally outwardly in opposite directions from said handle cover;

said handle extensions being disposed in a first plane, and said handle cover having a bent raised section disposed in a second plane spaced from said first plane to matingly match said mid-section of said pull handle for covering said pull handle;

first means for securing said handle cover to said pull handle;

second means for securing said handle extensions to the refrigerator door, said second means including handle extension bases provided at opposite ends of said pull handle in longitudinal alignment therewith, each of said handle extension bases matingly receiving an associate one of said handle extensions; and securement means for securing said handle extension bases to the refrigerator door, said securement means including longitudinally spaced apart legs extending outwardly from both of said handle extension base, to be securely received in associated slots provided in the refrigerator door.

24. A refrigerator door handle according to claim 23, wherein longitudinally extending tab means are provided on each of said legs to secure said legs in the slots provided in the refrigerator door.

25. A refrigerator door handle comprising:

a pull handle for securing to a refrigerator door, said pull handle having a raised mid-section to permit a user's fingers to grip thereunder;

an integral one piece extruded plastic profile consisting of a handle cover provided with handle extensions on opposite ends of said handle cover;

said handle extensions extending longitudinally outwardly in opposite directions from said handle cover;

said handle extensions being disposed in a first plane, and said handle cover having a bent raised section disposed in a second plane spaced from said first plane to matingly match said mid-section of said pull handle for covering said pull handle;

first means for securing said handle cover to said pull handle;

second means for securing said handle extensions to the refrigerator door, said second means including handle extension bases provided at opposite ends of said pull handle in longitudinal alignment therewith, each of said handle extension bases matingly receiving an associate one of said handle extensions;

securement means for securing said handle extension bases to the refrigerator door;

longitudinally extending reinforcement ribs extending outwardly from an outer surface of said pull handle and from outer surfaces of said handle extension bases; and flange means extending longitudinally along an inner surface of said handle cover and along inner surfaces of said handle extensions for coacting with said reinforcement ribs to secure said handle cover and handle extensions to said pull handle and handle extension bases.

26. A refrigerator door handle comprising:

an integral one piece extruded plastic profile consisting of a pull handle provided with handle extensions on opposite ends of said pull handle;

said profile being a longitudinally extending hollow tube having a top wall, a base wall and side walls connected between said top and base walls;

a longitudinally extending reinforcing strut being provided from said top wall to said base wall;

said handle extensions extending longitudinally outwardly in opposite directions from said pull handle;

said handle extensions being disposed in a first plane, and said pull handle having a bent raised section disposed in a second plane spaced from said first plane to provide a space for receiving a user's fingers to permit said pull handle to be gripped thereunder; and securement means for securing said handle extensions to the refrigerator.

27. A refrigerator door handle according to claim 26, including means for closing opposite free ends of said handle extensions.

28. A refrigerator door handle according to claim 26, wherein said side walls are inclined inwardly towards said top wall to provide a trapezoidal cross-section.

29. A refrigerator door handle according to claim 26, wherein said securement means includes an adhesive.

30. A refrigerator door handle comprising:

an integral one piece extruded plastic profile consisting of a pull handle provided with handle extensions on opposite ends of said pull handle;

said profile being a longitudinally extending hollow tube having a top wall, a base wall and side walls connected between said top and base walls;

said handle extensions extending longitudinally outwardly in opposite directions from said pull handle;

said handle extensions being disposed in a first plane, and said pull handle halving a bent raised section disposed in a second plane spaced from said first plane to provide a space for receiving a user's fingers to permit said pull handle to be gripped thereunder; and securement means for securing said handle extensions to the refrigerator, said securement means including longitudinally spaced apart legs extending outwardly from both of said handle extensions to be securely received in associated slots provided in the refrigerator door.

31. A refrigerator door handle according to claim 30, wherein said side walls are inclined inwardly towards said top wall to provide a trapezoidal cross-section.

32. A refrigerator door handle according to claim 30, wherein said legs are disposed in one row extending centrally along a bottom surface of said base wall.

33. A refrigerator door handle according to claim 30, wherein said legs are disposed in two spaced apart rows extending along a bottom surface of said base wall.

34. A refrigerator door handle according to claim 30, wherein longitudinally extending tab means are provided on each of said legs to secure said legs in the slots provided in the refrigerator door.

35. A refrigerator door handle according to claim 34, wherein said tab means are provided only on one side of each of said legs.

36. A refrigerator door handle according to claim 34, wherein said tab means are provided on both opposing sides of each of said legs.

37. A refrigerator door handle according to claim 30, including means for closing opposite free ends of said handle extensions.

* * * * *